US005415621A

United States Patent [19]

Campbell

[11] Patent Number: 5,415,621

[45] Date of Patent: May 16, 1995

[54] MASSAGE DEVICE

[76] Inventor: James W. Campbell, 4501 Springcreek Box 131, Bonita Springs, Fla. 33923

[21] Appl. No.: 119,294

[22] Filed: Sep. 10, 1993

[51] Int. Cl.[6] ..... A61H 7/00

[52] U.S. Cl. ..... 601/87; 601/112; 601/136

[58] Field of Search ..... 601/15, 17, 18, 85, 601/87, 89, 93, 94, 97, 101, 103, 112, 114, 134, 135–138

[56] References Cited

U.S. PATENT DOCUMENTS

| | | | |
|---|---|---|---|
| 1,354,865 | 10/1920 | Winter | 601/135 X |
| 1,577,751 | 3/1926 | Puschall | 601/112 |
| 1,613,377 | 1/1927 | Blonguist | 601/85 |
| 2,232,474 | 2/1941 | Rauh | 601/112 |
| 2,714,381 | 8/1955 | Corley et al. | 601/134 |
| 3,030,967 | 4/1962 | Peyron | 601/93 X |
| 3,169,521 | 2/1965 | McCaw | 601/87 |
| 4,432,113 | 2/1984 | Gouge | 601/112 X |
| 4,498,462 | 2/1985 | Henley | 601/16 |
| 4,964,398 | 10/1990 | Jones | 601/114 X |
| 5,167,226 | 12/1992 | Laroche et al. | 601/101 X |

FOREIGN PATENT DOCUMENTS

| | | | |
|---|---|---|---|
| 296128 | 12/1988 | European Pat. Off. | 601/112 |
| 2403940 | 7/1975 | Germany | 601/87 |
| 2415426 | 10/1975 | Germany | 601/87 |
| 429021 | 7/1967 | Switzerland | 601/93 |
| 16772 | of 1902 | United Kingdom | 601/85 |

*Primary Examiner*—Robert A. Hafer
*Assistant Examiner*—Brian E. Hanlon

[57] ABSTRACT

A device that simulates massage of various parts of the human body by a human hand as closely as possible. The device involves providing two concentric planes, one created by the rotation of a main shaft, at its projection point of intersection with the applicator head, and the second the plane created by the exposed surface of the applicator head. The offset of these planes is adjustable with seventeen degrees being found to be ideal. The applicator head pivots throughout a complete 360 degrees of slow rotation without any turning torque being generated due to the placement of a ball bearing at its point of connection. These applicator heads, which are exchangeable, based on desired size, shape or consistency, are constructed of a flexible material such as rubber, latex, plastic or fabric and form a flexible envelope. Small pellets, or some other suitable material, are loosely enclosed in the applicator head and provide a contour conforming quality to the head. The massage device generates direct circularly rotating pressure without risking inflicting lateral trauma to the tissue of the patient. The device is envisioned to be primarily used from a stationary support stand where the point of contact with the patient, and the amount of pressure applied, can be controlled and uniformly maintained. Although the device can be used as a hand held massage machine if desired.

7 Claims, 2 Drawing Sheets

42
46
44
68
10
86
50
40
52
84
82
80
48
78
56
76
58
72
54
74
60

20
100
102
96
18
16
98
104
106
14
110
108

MASSAGE DEVICE

BACKGROUND OF THE INVENTION

1. Field of the Invention

This invention relates to a device that simulates, as nearly as possible, the feel and therapeutic benefits of a massage by human hands. Specifically it relates to the generation of a rolling action of the applicator head without imparting any circular rotation of the applicator head to the afflicted area of the patient. Further it relates to the contour conforming abilities of the device's head, being a flexible envelope loosely filled with small objects.

2. Brief Description of the Prior Art

In the art we find numerous attempt to provide a mechanical device that performs a massaging action on various parts of the human body. Generally these devices are of the vibrating variety. These devices vibrate back and forth, up and down, in circular patterns or a combination of several directions. Generally these devices have repetitious motions that shake the desired location. This type of treatment, while providing temporary relief, have the potential of damaging surrounding tissue. Any massage device which applies lateral pressure to the afflicted area, as all known device do, has the potential of inflicting damage to the patient. Applicant is unaware of any device that provides slow contour conforming circular pressure while maintaining a stationary position of contact and which pressure is directly transferred without undue lateral pressure being applied.

OBJECTS AND ADVANTAGES OF THE INVENTION

The primary object of this invention is to provide a therapeutic massage to patients. Other objects include;

a) to provide for rotating pressure to an afflicted area in a contour conforming manner.
b) to provide for the ability to control the pressure being applied to the afflicted area.
c) to provide for a gentle massage that is unlikely to facilitate damage to the afflicted area in inflammatory tissue cases.
d) to provide for rotation therapy while maintaining a stationary position by having a bearing absorbing the rotation of the shaft.
e) to provide for a flexible housing on the applicator assembly constructed of a material such as rubber, plastic or fabric.
f) to provide for a material to be contained within the flexible housing of the applicator assembly that facilitates the contour conforming property.
g) to provide for interchangeable head platforms, of various sizes, shapes and consistencies, to afford treatment of different locations on the human body and different medical conditions.
h) to provide for adjustments in the speed of the rotation generated by the device so as to accommodate various afflictions.
i) to provide for the device to be hand held by the therapist, doctor or patient during treatment.
j) to provide for a stationary platform to hold the device during treatment of the afflicted area.
k) to provide for an optional rocking action of the massage device, back and forth over the afflicted area, in an extremely slow manner, so as to expand the treatment area, while the massage device is attached to the stationary platform.
l) to provide for the versatility of the device by adjustment of the offset angle of the head.
m) to provide for the interchange of the flexible head unit on the head platform, of various sizes, shapes and consistencies, to afford treatment of different locations on the human body and different medical conditions.
n) to eliminate vibration massage which has the potential to damage tissue.

Other objects, advantages and features of the present invention will become apparent to those skilled in the art from the detailed description which follows. It should be understood, however, that the detailed description and specific examples, while indicating preferred embodiment, are given as examples and not limitations. Many changes and modifications to the invention are possible without departing from the spirit of the invention, and all such modifications are included. Thus the scope of the invention should be determined by the appended claims rather than the specific embodiments shown.

REFERENCE NUMERALS IN DRAWINGS

Figure 1:
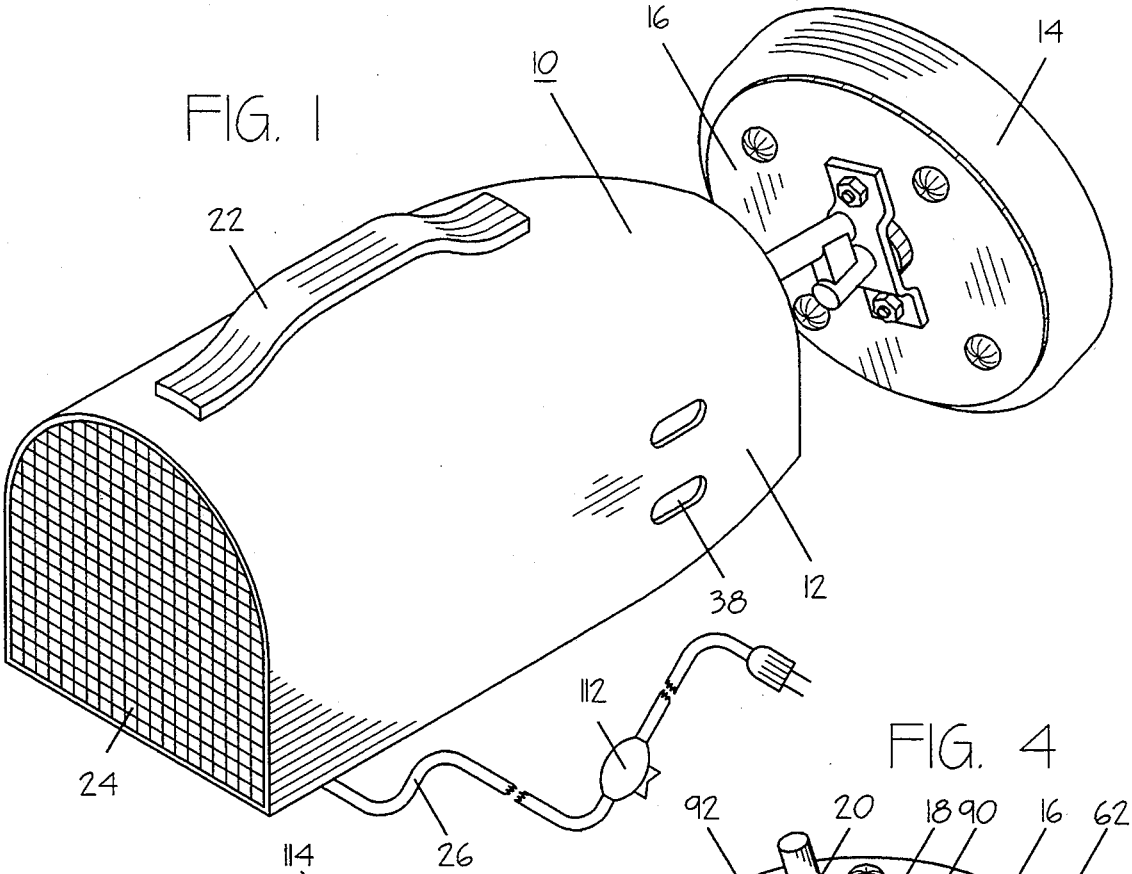
FIG. 1 is a perspective view of the massage device.

10. Massage device
12. Housing
14. Applicator
16. Plate
18. Angulated shaft
20. Main power shaft
22. Handle
24. Screen
26. Power connector
28. Retaining element
30. Ball bearing
32. Bearing
34. Very slow gear motor
36. Fan
38. Housing hole
40. Sleeve
42. Crane spool
44. Wire
46. Crank
48. Set screw handle
50. Pivotal extension
52. Locking handle
54. Stand
56. Very slow geared motor
58. Handle set screw
60. Caster
62. Expanded tab
64. Retaining hole
66. Coupling
68. Capping assembly 70. Torque conversion device
72. Staff
74. Stabilizing extension
76. Switch
78. Yoke
80. Pivotal engagement
82. Slot
84. Stationary extension
86. Locking handle
88. Shaft connection
90. Bolt
92. Nut
94. Pellet
96. First adjustment member
98. Second adjustment member
100. First pivot connector
102. Second pivot connector
104. Attachment hole
106. Attachment peg
108. Locking member
110. Locking hole
112. Switch
114. Rotation shaft

SUMMARY OF THE INVENTION

A device that will administer a therapeutic massage without inflicting additional damage to the afflicted area or surrounding tissue. An extremely slow rotation turns a contour conforming head. A main drive shaft from the slow revolution motor form a plane at the projected point of intersection with the patient contacting surface of the applicator head. This surface of the applicator head, which would contact the skin of the patient, forms a second plane. These two planes are concentric, having the same center point. These two planes are slightly offset, with seventeen degrees being found to be ideal, though variation is possible. This offsetting results in the application of pressure in a rotating circular pattern. The contour conforming head is constructed of a flexible material which forms a circular envelope which contains numerous small objects which provide for the shifting of this enclosed material during the rotation. This action allows for the squeezing of this material so as to provide an even pressure at the location of contact throughout the 360 degrees of the circular rotation. A bearing is provided between the applicator head and the angulated shaft to absorb the torque generated by the rotation of the main shaft. While the head wobbles though the complete rotation, an even rolling sensation is produced which simulates the even sensation and therapeutic benefits of the massage of a human hand. Abrasion to the surface of the afflicted area is completely eliminated as the contact surface of the applicator head is not turning relative to the treated area but rather is rolling over the area in a circular pattern. Because lateral pulling is not present during the treatment, the potential for damage to tissue is effectively eliminated.

DESCRIPTION OF THE PREFERRED EMBODIMENT

Referring now to the drawings where like reference numerals refer to like parts throughout the various views. FIG. 1 is a perspective view of a massage device 10 having a housing 12 with housing holes 38 which permit the flow of air for cooling of the motor contained within. Additionally a screen 24 is provided, having the same general function of holes 38, while providing protection from dirt and accidental contact with the equipment contained within. A power connector 26 having a switch 112, provides electrical power to the motor contained within housing 12. A handle 22 is provided to allow convenient handling of massage device 10 during treatment or transport. Attached to and part of massage device 10 is a plate 16 having an applicator 14 attached thereto. Applicator 14, being constructed of a pliable material such as latex rubber, is flexible, and forms an inclusive envelope.

Figure 2:
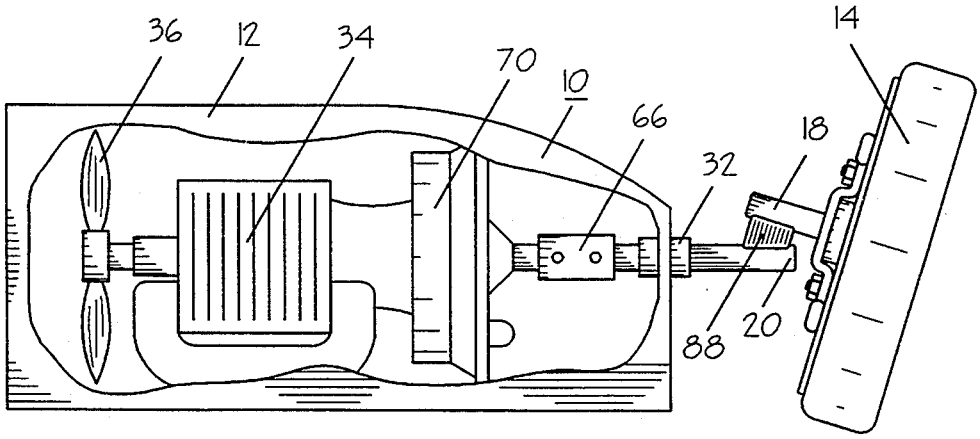
FIG. 2 is a plan view of the massage device with part of the housing case cutaway to show the interior.

FIG. 2 is a plan view of massage device 10 having a housing 12 which is shown with a section cutaway to reveal various components installed within. Shown is a very slow gear motor 34 capable of generating shaft rotation and having a fan 36 to provide cooling. A torque conversion device 70 converts shaft rotation to allow a main power shaft 20 to be rotated at a predetermine rate of rotation. Main power shaft 20 is connected to very slow gear motor 34 utilizing coupling 66. A bearing 32 is provided to permit main power shaft 20 to pass through housing 12. Attached to main power shaft 20 utilizing a shaft connection 88 is an angulated shaft 18. An applicator 14 is attached to angulated shaft 18. It should be noted that the projection point of angulated shaft 18 where it meets the face of applicator 14 is the same as the projection point of main power shaft 20 where it meets the face of applicator 14. Therefore during rotation this mutual point will remain relatively stationary. While widely varying angles are possible for the offset angle between main power shaft 20 and angulated shaft 18, extensive experimentation has discovered that seventeen degrees provides optimum effect.

Figure 3:
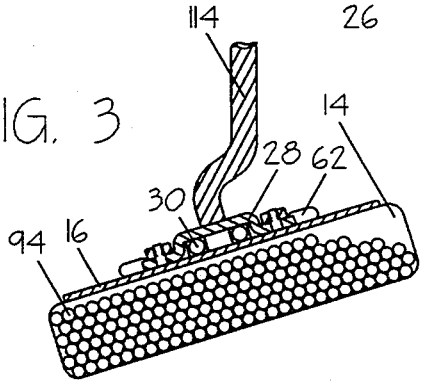
FIG. 3 is a plan cutaway view of an embodiment of the head of the massage device.

FIG. 3 is a cutaway plan view of the head of the device. Shown is rotation shaft 114 connected to a bearing assembly having a ball bearing 30 which is secured to plate 16 utilizing a retaining element 28. It being understood that a one piece shaft is possible with the desired offset angle incorporated into its design. Ball bearing 30 has the purpose of absorbing all torque generated by rotation of rotation shaft 114. Connecting applicator 14 to plate 16 is facilitated using expanded tabs 62. It being understood that when the facing surface of applicator 14 is in contact with a patient that the force generated by rotation of rotation shaft 114 would impart a 360 degree wobble of applicator 14 and result in a circular pattern of pressure being provided. Loosely contained within applicator 14 is a plurality of pellets 94 forming the filling material. Being loosely contained within the soft and flexible material that forms applicator 14, pellets 94 have the property of conforming to the contours of the surface being treated. While round pellets are disclosed, and based on extensive experimentation, have the best physical properties for the application, many different shapes, consistencies and sizes of the filling material are envisioned.

Figure 4:
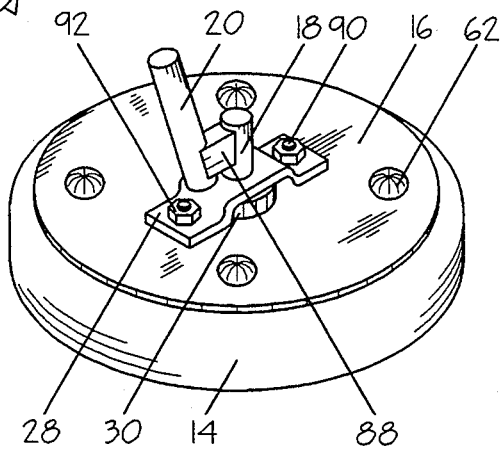
FIG. 4 is a perspective view of the head of the massage device.

FIG. 4 is a perspective view of applicator 14 with plate 16 attached utilizing expanded tabs 62. Attached to plate 16 are bolts 90 which act with nuts 92 to secure retaining element 28 to plate 16. Retaining element 28 secures ball bearing 30 to plate 16 and angulated shaft 18. Angulated shaft 18 is connected to main power shaft 20, at a predetermined offset angle, by shaft connection 88.

Figures 5, 6:
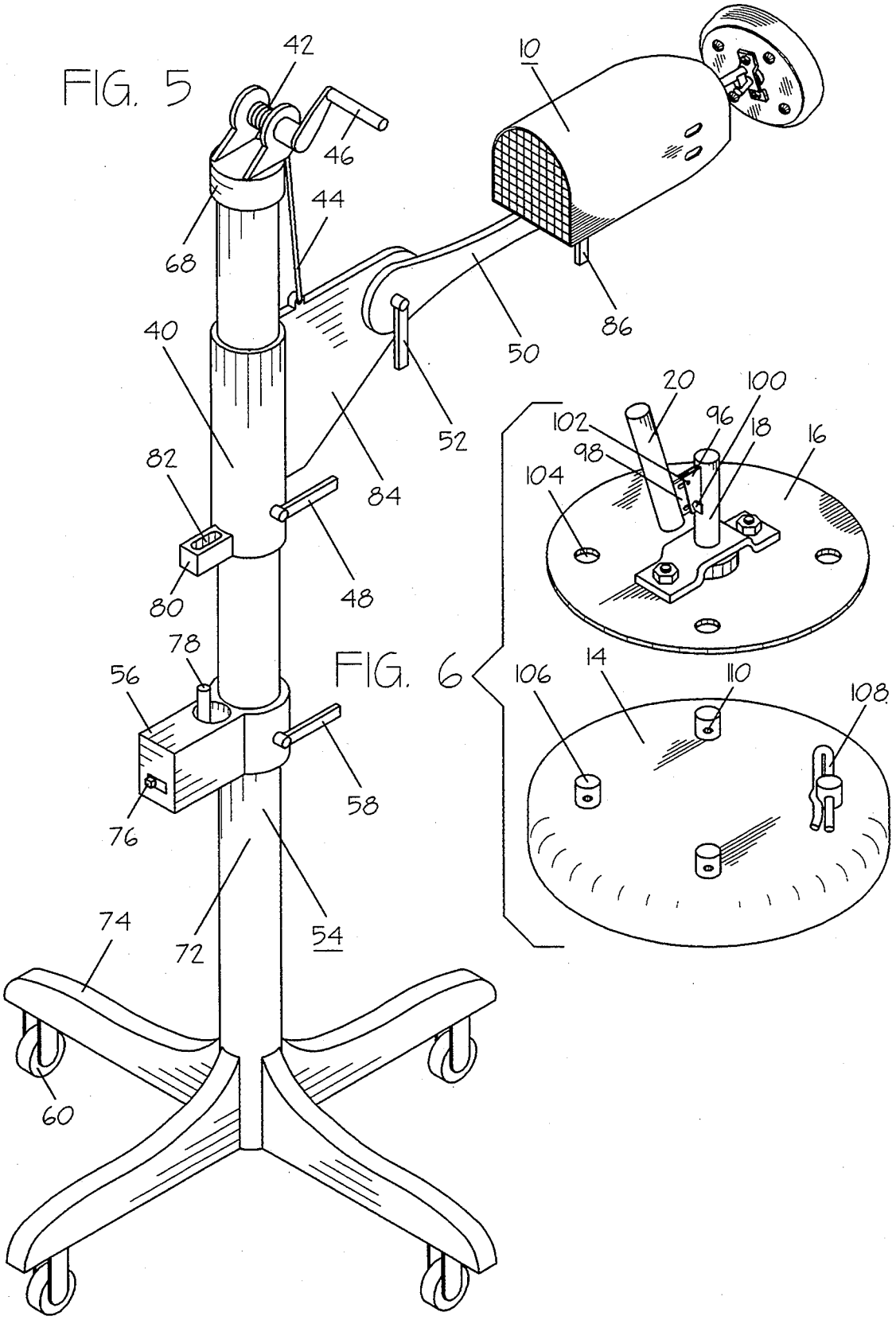
FIG. 5 is a perspective view of an adjustable stand with the massage device attached.
FIG. 6 is a perspective view of an applicator head detached from plate with adjustable shafts.

FIG. 5 is a perspective view showing a stand 54 having a plurality of stabilizing extensions 74 each having a caster 60. Casters 60 provide stand 54 with the ability to be easily moved and positioned. Stand 54 has a staff 72 which has attached a very slow geared motor 56, turning at approximately one revolution per minute, and having a switch 76 which activates and deactivate a yoke 78. A handle set screw 58 is provided to securely position the assembly at a desired height. Directly above is a sleeve 40 having a set screw handle 48 which can be engaged to securely attach sleeve 40 to staff 72 at a desired height. Sleeve 40 has a pivotal engagement 80 having a slot 82 which engages yoke 78 when an extremely slight rocking action of device 10 is desired during treatment. This optional rocking action, which would have the purpose of enlarging the treatment area by, as example ten inches, would pass the massage applicator head back and forth very slowly over the afflicted area. This cycle of moving from first end of cycle to second end of cycle would be complete over a relatively long period of time, as example thirty seconds. During this engagement set screw handle 48 would be disengaged to allow a back and forth motion to sleeve 40 which would be transferred to stationary extension 84. During this optional treatment technique, sleeve 40 would be supported by very slow gear motor 56 which would be locked to staff 72 utilizing handle set screw 58. Sleeve 40 is raised and lowered on staff 72 by engaging a crank 46 which causes wire 44, attached to stationary extension 84, to be retracted or extended from a crane spool 42 attached to a capping assembly 68. It being understood that crane spool 42 would having locking means to prevent movement of sleeve 40 without direct hand involvement of the operator, to prevent unexpected lowering of the device. Attached to stationary extension 84 is a pivotal extension 50 which is secured at a desired angle to stationary extension 84 by a locking handle 52. Massage device 10 is securely attached to pivotal extension 50 utilizing a locking handle 86 which permits adjustment of the angle that massage device 10 is held relative to pivotal extension 50.

FIG. 6 is an exploded perspective view of applicator 14 and plate 16. It being understood that various configurations of applicator 14 are possible in the form of various sizes, densities, consistencies or shapes, amongst others. One possible embodiment of a removable and interchangeable applicator 14 is shown having attachment pegs 106 each having a locking hole 110. Shown inserted in one locking hole is a locking member 108. In use applicator 14 would be attached to plate 16 by inserting all attachment pegs 106 through corresponding attachment holes 104 in plate 16. Then locking members 108 would be inserted through locking holes 110 and applicator 14 would be securely attached to plate 16. Attached to plate 16 is angulated shaft 18 having attached a first adjustment member 96. Main power shaft 20 having attached a second adjustment member 98 is provided. Connecting first adjustment member 96 to second adjustment member 98 is a first pivot connector 100 and a second pivot connector 102. It being understood that this configuration allows for the secure setting of the offset angle of main power shaft 20 relative to angulated shaft 18.

It being further understood that a one piece shaft, as disclosed in FIG. 3, with the required bends incorporated in its design, will impart the desired offset angle. The imparting of an offset angle, whether that be facilitated by a single bent shaft or utilizing two or more shafts with various connection means, has the purpose of imparting a 360 degree tilt pressure to the contact surface of the applicator head of the device.

CONCLUSIONS AND RAMIFICATION OF THE INVENTION

While the general size and shape of the applicator head illustrated is adequate for the treatment of many afflicted areas, various sizes and shapes are envisioned for specialized areas of treatment. Generally any muscle or muscle group will be treatable by utilizing the invention. While the illustrations disclose the removal, and therefore the exchange of the receptacle or applicator, the entire applicator head, with plate and attaching hardware, is envisioned as being exchangeable as a set and is disclosed. While electric power in the form of a standard 110 volt outlet is envisioned as being the most practical source of power, the use of battery power is envisioned and disclosed.

While several embodiments of the invention have been described, it will be understood that it is capable of still further modifications, and this application is intended to cover any variation, uses, or adaptations of the invention, following in general the principles of the invention and including such departures from the present disclosure as to come with the knowledge of customary practice in the art to which this invention pertains, and as may be applied to the essential features hereinbefore set forth and falling within the scope of the invention or the limits of the appended claims.

I claim:

1. A massage device comprising;

a) rotation generation means, said rotation generation means to produce rotation;

b) a shaft, said shaft being rotated by said rotation generation means, said shaft having a rotation attachment portion having first and second ends and a massage applicator assembly portion having first and second ends, said rotation attachment first end connected to said rotation generation means;

c) control means, said control means to initiate rotation of said shaft and to terminate rotation of said shaft;

d) a massage applicator assembly, said massage applicator assembly to provide concentric rolling yielding therapeutic pressure massage, said massage applicator assembly comprising;

1) an envelope, said envelope being constructed of a flexible material, said envelope having a patient contacting surface for being in contact with a patient during operation of said massaging device;

2) filling material, said filling material being a plurality of objects having a predetermined geometric shape, said filling material completely enclosed within said envelope and being yielding;

3) an applicator anterior side, said applicator anterior side being one side of said massage applicator assembly and comprising said envelope;

4) an applicator posterior side, said applicator posterior side being one side of said massage applicator assembly and being opposite said applicator anterior side of said massage applicator assembly;

5) a connection point, said connection point being a centrally positioned point on said applicator posterior side of said massage applicator assembly;

6) a bearing assembly, said bearing assembly securely attached to said connection point of said massage applicator assembly, said bearing assembly absorbing said rotation of said shaft, said massage applicator assembly being free turning relative to said shaft; and e) offset means, said offset means for imparting an offset angle between said rotation attachment portion of said shaft and said massage applicator assembly portion of said shaft, said offset means being an angled member connecting said rotation attachment second end and said massage applicator assembly first end, said offset means producing a projected point of intersection between said attachment end of said shaft and said patient contacting surface of said envelope, said offset angle imparting concentric wobble to said massage applicator assembly relative to said shaft;

whereby said rotation generation means would cause said shaft to turn which would transfer offset rotation to said bearing assembly which would absorb all rotation and would allow for continual concentric tilt pressure through said massage applicator assembly without any rotation of said massage applicator and said applicator assembly would allow for the continual readjustment of said filling material during the tilt pressure as to conform, yet provide relatively perpendicular pressure to the area immediately in contact with said patient.

2. The invention defined in claim 1 further comprising a stand, said massage device securely attached to said stand to provide secure support to said massage device.

3. The invention defined in claim 2 wherein said stand further comprises height adjustment means to permit stationary placement of said massage device and angle adjustment means to facilitate angular placement of said massage device.

4. The invention defined in claim 2 wherein said stand further comprising pivotal means to facilitate a slight rocking action of said massage device.

5. The invention defined in claim 1 further comprising a handle, said handle securely attached to said massage device for hand held operation of said massage device.

6. The invention defined in claim 1 further comprising, angle adjustment means, said angle adjustment means allowing for altering of said offset angle whereby said offset angle can be adjusted to accommodate the specific treatment requirements of said patient.

7. The invention defined in claim 1 wherein said offset angle is approximately seventeen degrees.

* * * * *